US007131880B2

(12) United States Patent
Bettinelli et al.

(10) Patent No.: US 7,131,880 B2
(45) Date of Patent: Nov. 7, 2006

(54) PROCESS FOR MANUFACTURING BARRIERS FOR A PLASMA DISPLAY PANEL

(75) Inventors: Armand Bettinelli, Voiron (FR); Jean-Claude Martinez, Chartres de Bretagne (FR)

(73) Assignee: Thomson Licensing, Boulogne-Billancourt (FR)

( * ) Notice: Subject to any disclaimer, the term of this patent is extended or adjusted under 35 U.S.C. 154(b) by 197 days.

(21) Appl. No.: 10/451,609

(22) PCT Filed: Dec. 21, 2001

(86) PCT No.: PCT/EP01/15260

§ 371 (c)(1), (2), (4) Date: Oct. 14, 2003

(87) PCT Pub. No.: WO02/052602

PCT Pub. Date: Jul. 4, 2002

(65) Prior Publication Data

US 2004/0092194 A1 May 13, 2004

(30) Foreign Application Priority Data

Dec. 22, 2000 (FR) ..... 00 16838

(51) Int. Cl.
*H01J 9/00* (2006.01)

(52) U.S. Cl. ..... 445/24

(58) Field of Classification Search ..... 445/24, 445/25, 43

See application file for complete search history.

(56) References Cited

U.S. PATENT DOCUMENTS 5,714,840 A 2/1998 Tanabe et al. ..... 313/581
6,632,116 B1 * 10/2003 Watanabe et al. ..... 445/24
6,800,010 B1 * 10/2004 Hibino et al. ..... 445/25
6,872,115 B1 * 3/2005 Sakurai et al. ..... 445/66
2004/0169471 A1 * 9/2004 Bettinelli et al.

FOREIGN PATENT DOCUMENTS

EP 1017083 7/2000
JP 11-219659 8/1999
JP 11-283497 10/1999

OTHER PUBLICATIONS

Patent Abstracts of Japan, vol. 2000, No. 01, Jan. 31, 2000 and JP 11-283497.

Patent Abstracts of Japan, vol. 1999, No. 13, Nov. 30, 1999 And JP 11-219659.

Copy of Search Report dated May 16, 2002.

* cited by examiner

*Primary Examiner*—Joseph Williams
*Assistant Examiner*—Hana Sanei
(74) *Attorney, Agent, or Firm*—Joseph J. Laks; Harvey D. Fried; Richard LaPeruta

(57) ABSTRACT

Process comprising the following steps: a) deposition of a green layer based on 0.1% of an organic binder, on a mineral filler and on 0.1% to 13% of a mineral binder; b) formation of the barriers by spraying an abrasive material onto a mask applied against this layer, and then removal of the mask; c) deposition of a phosphor-based green layer; d) baking of the two layers, preferably simultaneously. By virtue of the limited amount of organic binder, the abrasion rate is high; if this content is at least 2%, deterioration of the green barriers is avoided.

18 Claims, No Drawings

PROCESS FOR MANUFACTURING BARRIERS FOR A PLASMA DISPLAY PANEL

This application claims the benefit, under 35 U.S.C. § 365 of International Application PCT/EP01/15260, filed Dec. 21, 2001, which was published in accordance with PCT Article 21(2) on Jul. 4, 2002 in English and which claims the benefit of French patent application No. 0016838, filed Dec. 22, 2000.

The invention relates to a process for manufacturing barriers intended to separate the discharge cells of a plasma display panel and to the tiles and plasma panels provided with the barriers obtained by this process.

Plasma panels for displaying images generally comprise two parallel flat tiles provided with arrays of electrodes; the intersections between the electrodes of different arrays define, between the tiles, discharge spaces generally filled with low-pressure gas. When the panel is in use, suitable voltages are applied between the electrodes in order to obtain light-emitting electrical discharges in these spaces. To separate these discharge spaces or groups of discharge spaces, barriers are generally placed between these spaces or groups of spaces; these barriers then form an array which is also placed between the tiles and defines the discharge cells of the panel. These barriers then serve as spacers between the two parallel tiles and must be able to withstand the atmospheric pressure exerted on these tiles. Whereas the discharges generally emit in the ultraviolet, to obtain emission of visible light, layers of phosphors are generally placed on the walls of the cells; for this purpose, the sidewalls of the barriers are generally covered with phosphors.

In general, the manufacture of these barriers therefore involves the production of an array of barriers on at least one of the tiles; these barriers are generally made of a mineral material which is sufficiently stable under the effects of the discharge.

To prepare a tile provided with an array of barriers made of mineral material defining discharge cells, document EP 0 722 179 discloses a process comprising the following steps:

- deposition of a green layer of uniform thickness based on a powder of the barrier material and on an organic binder,
- after deposition, formation of the green barriers by ablating portions of the green layer in the discharge cells;
- deposition of a green layer, based on a phosphor and on an organic binder, on the walls of the discharge cells, especially on the sidewalls of the barriers; and
- at least one baking operation under suitable conditions, so as to at least remove the organic binder from the green layers and, in the case of the green barrier layer, to consolidate the mineral barrier material.

Before these steps, the tile is in general provided beforehand with at least one electrode array, with a dielectric layer in the case of AC panels with a memory effect, or even a protective layer generally based on magnesia (MgO); transparent glass tiles are generally used, especially for the front face of the panel.

The thickness of the green layer of barrier material is generally between 50 μm and 200 μm.

The thickness of the green layer of phosphors is generally about 15 μm. More specifically, the deposition of this green layer is subdivided into several operations suitable for applying the suitable phosphors—red, green or blue—in each cell of the panel.

In this process, it is possible:

- either to carry out a first baking operation after the barriers have been formed and then a second baking operation after the phosphors have been deposited;
- or to carry out a single baking step, in which the barriers and the layers of phosphors are baked simultaneously, after the phosphors have been deposited.

The advantage in carrying out a single simultaneous baking step is essentially an economic one; however, in the most frequent case of manufacturing barriers whose bulk density is greater than 75% of the theoretical density of the material of the mineral filler, this material generally comprises more than 14% of a glassy phase, and the simultaneous baking results in significant migration of this phase into the phosphors and significant degradation in the performance of these phosphors; in the case of dense barriers called "non-porous" barriers, it is therefore impossible in practice to carry out a single simultaneous baking step.

As a result, the mineral material of the barriers generally contains more than 14% by weight of glass, which advantageously makes it possible, on the one hand, to limit the baking temperature in order to prevent the tile from deforming excessively, especially when it is made of soda-lime glass, and, on the other hand, to achieve consolidation of the barriers sufficient for them to be able to withstand the atmospheric pressure exerted by the tiles against them. The porosity of such barriers is therefore very low, especially since any residual porosity poses degassing problems which seriously impair the operation of the panel. When a mineral barrier material is used containing more than 14% by weight of glass, the baking conditions are therefore adapted so as to prevent as far as possible any residual porosity after baking, which penalizes the process.

Document U.S. Pat. No. 4,037,130 discloses the case of barriers based on alumina containing more than 14% by weight of glass, which barriers are, however, porous; the significant porosity of the barriers is intended here to lower the dielectric constant. The area of the surface carrying the barriers is in this case very high so that a low specific mechanical strength of the barrier material is sufficient to withstand the atmospheric pressure exerted by the tiles.

More precisely, if the pressure exerted by the tiles corresponds to an atmospheric pressure of $10^5$ Pa and if, in the cell configuration described in this document U.S. Pat. No. 4,037,130, the area of the surface carrying the barriers corresponds to more than 60% of the area of the tile, the force exerted on the barriers will not exceed $1.7\times10^5$ N/m$^2$.

Mineral barriers of high porosity also have other advantages:

- ease of pumping the panel in the case of supporting barriers in contact with the tiles both via the base and via the top when, once both panels have been assembled, the gas trapped between these tiles has to be evacuated in order to replace it with a gas capable of low-pressure discharge;
- the surface of the pores of these barriers has an adsorption effect which makes it possible to adsorb residual gases trapped between the tiles after the panel has been sealed, which gases would run the risk of poisoning the discharges in the cells and of seriously disturbing the operation of the panel; this therefore avoids having to add adsorbent materials to the panel, as described in document EP 0 911 856.

With the aim of increasing the definition of the images displayed by these panels, it is sought to reduce the size of the pixels and therefore the width of the barriers. For the purpose of improving the brightness of the panels, it is also sought to reduce the width of the barriers; since the atmospheric pressure exerted by the tiles is then applied on narrower barriers, the barriers therefore have to withstand larger forces.

In a conventional case of an array of parallel barriers of identical width, which separate groups of cells belonging to the same column and are coated with the same phosphor, if the pitch between columns is 360 μm and the width of a barrier is less than 100 μm, the force exerted on the barriers then exceeds $3.6\times10^5$ N/m$^2$. In this case, it is therefore much more difficult to use highly porous barriers since there is a risk of them no longer having sufficient mechanical strength.

In the barrier manufacturing process described above the process for forming the green barriers by ablating portions of the previously deposited homogeneous green layer is conventionally carried out according to the following steps:

application, to the green barrier layer, of a protective mask provided with patterns corresponding to the array of the barriers to be formed;

blasting of an abrasive material onto the mask so as to remove the green barrier layer between the patterns of the mask;

removal of the mask.

In this way, a tile provided with a green array of barriers is obtained.

As protective mask, it is general practice to use a film based on a polymer material which is sufficiently resistant to the impact of the abrasive material under the blasting conditions. In general, it is the flexibility of this material which allows it, because of the elastic nature, to withstand the impacts of the abrasive material.

To apply the protective mask with the barrier patterns, use is made, for example, of screen printing or preferably the technique of photolithography. In this case a developable polymer material is used. A masking layer of uniform thickness is then applied to the green barrier layer, an image of the barrier patterns is formed on this masking layer so as to crosslink the polymer in these patterns and then the uncross linked parts of the masking layer are removed.

To improve the adhesion of the masking layer to the green barrier layer, the process as described in document EP 6 039 622 may be carried out; this therefore substantially improves the definition of the patterns formed during the abrasion step which follows.

It is general practice to use, as abrasive material, a solid powder, or "sand", such as for example glass beads, metal balls or calcium carbonate powder—the operation is then termed "sandblasting". A liquid may also be used as abrasive material.

After sandblasting, the barriers are formed, these generally comprising a base, a top and sidewalls; the mask then covers the top of these barriers. To remove this mask, high-pressure spraying of a suitable solution is generally carried out in order to make the mask disappear from the top of the barriers. The solution is generally a gently heated basic aqueous solution.

Whether or not an intermediate step of baking the green barrier layer is carried out, the tile provided with an array of barriers, whether green or baked, is then ready for the operations of depositing the green layer of phosphors; preferably, the conventional technique of direct screen printing is used for one deposition operation, by carrying out the following steps:

preparation of a slip essentially comprising the phosphor to be applied, an organic binder and at least one solvent or suspension liquid;

application of this slip to the tile through a screen-printing screen having openings facing the regions to be covered with this phosphor; and evaporation of the solvent.

By repeating these operations for each type of phosphor to be applied, a tile provided with an array of barriers whose sidewalls are coated with phosphors is then obtained. The bottom of the discharge cells bounded by these barriers is then also coated with phosphors.

It would also be possible to use the technique of photolithography to deposit phosphors, this technique allowing better definition combined with whole-surface deposition carried out, for example, by spraying in order to limit the mechanical stresses applied to the sidewalls of the barriers. However, this technique involves considerable scrapping of material containing phosphors and expensive operations to recycle this scrap.

The baking operation or operations are carried out under conditions suitable for removing the organic binder from the green layers and, in the case of the barrier layer, for consolidating the mineral material of the barrier. The organic compounds are generally removed below 380° C. and, in a first step of the baking heat treatment, the temperature is gradually raised to the above temperature so as to remove these compounds without damaging the structure of the green layers. Thereafter, especially in the case of the barrier layer, in a second step of the heat treatment, the materials is heated up to at least a temperature close to that of the softening temperature of the mineral binder incorporated into these layers.

When manufacturing barriers of high porosity, the conditions of the second step of the baking heat treatment are adapted so as to obtain sufficient consolidation of the barrier material while maintaining a high porosity. It has been found that a baking operation carried out under these conditions does not in general cause any shrinkage.

When manufacturing barriers of high porosity using the process of the aforementioned type, in which the green barriers are formed by sandblasting after a mask of polymer material has been applied, the following problems have been found:

excessively slow rate of abrasion of the green layer by sandblasting;

difficulty of removing the sandblasting mask without damaging the array of the green barriers.

Furthermore, when the phosphors are deposited by screen-printing, it has been found that it is difficult to apply the phosphors to the sidewalls of the barriers without damaging them.

The object of the invention is to solve these problems.

For this purpose, the subject of the invention is a process for manufacturing an array of barriers made of a mineral material on a tile intended for the manufacture of a plasma display panel, comprising the following steps:

on the said tile, deposition of a green layer of uniform thickness based on a powder of the barrier material and of an organic binder;

application, to the green barrier layer, of a protective mask made of a polymer material, provided with patterns corresponding to the array of the barriers to be formed;

blasting of an abrasive material onto the mask so as to remove the green barrier layer between the patterns of the mask and to form green barriers comprising a base, a top and sidewalls;

removal of the mask;

deposition of a green layer, based on a phosphor and an organic binder, at least on the sidewalls of the barriers;

at least one baking operation, at least under conditions suitable for removing the organic binder from the green barrier layer and/or from the green layer of phosphors and, when baking the barrier layer, at least for consolidating the mineral barrier material;

characterized in that:

the powder of the barrier material comprises a mineral filler and a mineral binder, the weight content of mineral binder in this powder being less than 13% and greater than 0.1%; and the weight content of organic binder in the said green barrier layer is less than 8% and greater than 0.1%.

In this process, the phosphors may be deposited by screen printing or by photolithography.

According to the invention, it has been found that too high a content of organic binder in the green barrier layer is prejudicial to the rate of abrasion and the rate of formation of the green barriers; a content of less than 8% obviates this drawback.

Without being limited to an exclusive explanation, it seems that a content of greater than or equal to 8% of organic binder significantly reduces the rate of abrasion because the impacts of the abrasive material blasted against the green barrier layer then become too elastic.

The invention may also have one or more of the following features:

the process comprises no baking step between deposition of the green barrier layer and deposition of the green layer of phosphors, and these two green layers are baked simultaneously.

Thus, preferably, a single baking step is carried out in which the barriers and the layer of phosphors are baked simultaneously, after the phosphors have been deposited, since it would be difficult to apply the phosphors to barriers that have been baked beforehand, these being highly porous and therefore of low mechanical strength, without the risk of damaging them.

Since, according to the invention, the barrier material contains less than 13% of binder material, the risk of this binder migrating into the phosphors is considerably limited, even when both green layers are baked simultaneously in a single baking operation, and the phosphors are no longer at risk of being seriously damaged.

Simultaneous baking means that the phosphors are deposited on green barriers, and therefore on a material which advantageously has a much higher mechanical strength than these same barriers after baking, especially when the baked barriers obtained are highly porous. This therefore prevents the deposition of phosphors from damaging the array of barriers, the green barriers obtained having a relatively low porosity.

Preferably, to improve the mechanical strength of the green barriers, the weight content of organic binder in the green barrier layer is greater than or equal to 2%. It has in fact been found that an organic binder content of less than 2% in the green barrier layer runs the risk of damaging the array of green barriers during the step of removing the mask; according to the invention, using a content greater than or equal to 2% avoids this drawback.

It is therefore important for the mechanical properties of the green barriers to be high, in order to be able to deposit the phosphors, for example by screen printing or by photolithography, without damaging them; it is important for the green barriers to have a low porosity in order to achieve good development when deposition is by photolithography (a high porosity prevents the phosphor particles from being properly removed from the regions that are not to be coated).

Again for the purpose of preserving the integrity of the barriers, it is highly preferable, when using a solvent for the organic binder of the green layer of phosphors for depositing this layer, that this solvent be chosen so as not to dissolve the organic binder of the green barriers.

Another advantage of this simultaneous baking is that it avoids having to deposit an intermediate layer between the sidewalls of the barriers and the phosphors; this is because, when the barriers are baked before the phosphors are deposited, it is common practice to deposit an intermediate layer called a reflection layer, which also has the purpose of improving the distribution of phosphors over the entire surface of the sidewalls of the barriers. Such intermediate deposition is no longer useful for this purpose and, by depositing the green layer of phosphors directly on the sidewalls of the green barriers it has been found that the distribution of phosphors is very homogeneous over the entire surface of the sidewalls of the barriers. It has been found that the uniformity of this distribution is favoured by the open porosity of the green barrier layer, which is itself favoured by the low organic binder content of this layer, which is intrinsic to the invention, it being possible, for example, for the open porosity of the green barrier layer to be about 1% to 2%;

the particle size of the powder of the barrier material, especially of the mineral filler, the nature of the mineral binder, its weight content in this powder, the method of mixing the components in this powder and the baking conditions are tailored so that the bulk density of the barriers obtained after baking is less than 75% of the theoretical density of the material of the mineral filler.

Barriers whose pores represent at least 25% of the volume are thus obtained. The expression "bulk density of the barriers" is understood to mean the mass of these barriers divided by their external volume; thus, if the mineral filler is based on alumina, the theoretical density of which is about 3.9 g/cm$^3$, the bulk density of the barriers remains less than 2.73 g/cm$^3$ and these barriers remain porous enough to facilitate the pumping of the panel and to provide gas adsorptivity sufficient to keep the panel at low pressure throughout its lifetime (getter effect).

Since the sidewalls of the baked barriers are then also highly porous, the phosphors adhere much better to these sidewalls than to those of conventional low-porosity barriers.

Preferably, to obtain this high porosity, the simultaneous baking conditions are suitable for preventing any significant shrinkage during this baking.

Preferably, to avoid excessive migration of the glassy phase of the mineral binder during baking, while still obtaining good consolidation of the barriers, the maximum temperature reached during simultaneous baking is more than 20° C. to 50° C. above the softening temperature of the mineral binder of the barrier material. Particularly when higher mineral binder contents are used, it is recommended to avoid reaching excessively high temperatures in order to prevent excessive migration of the glassy phase of the mineral binder, which would end up coating the filler particles to the point of dramatically limiting the gas adsorption effect (getter effect) of these particles; baking temperatures of between +20° C. and +50° C. above the softening temperature have given the best results;

the particle size of the powder of the barrier material, especially of the mineral filler, the nature of the mineral binder, its weight content in this powder, the method of mixing the components of this powder and the baking conditions are tailored so that the barriers obtained after baking have a mechanical strength allowing it to withstand a pressure of greater than $3\times10^5$ N/m$^2$.

Barriers that are both porous and strong are therefore obtained—such barriers are advantageously suitable for panel structures in which the supporting area of the barriers represents less than 25% of the area of the tiles. In the case of a panel whose barriers have a width of 100 μm at the base and a width of 70 μm at the top, in which the pitch of the barriers is 360 μm, the supporting area represents 70/360=19.4% of the area of the tiles.

The mineral filler is chosen from mineral substances which are stable in the baking temperature ranges, have a high adsorptivity and, if possible, have a low dielectric constant. Preferably, this filler is chosen from the group comprising alumina, zirconia, yttrium oxide and mixtures thereof, alumina especially because it is an amphoteric powder having high adsorbent properties and zirconia especially because it has a low dielectric constant The mineral filler may also include substances such as mullite, cordierite or zeolites. Although it possesses a high dielectric constant, titanium oxide can also be used, especially for its reflecting properties.

Preferably, the mineral filler has a green density greater than 50% of its theoretical density.

Tests carried out with mineral fillers having a green density of about 65% of the theoretical density, or even more, have given the best results. After baling, mechanical strengths exceeding $3\times10^5$ N/m$^2$ are achieved, even if the maximum temperature reached during the baking step exceeds the softening temperature of the glass used as mineral binder by only 20° C.

It has been found that the use of powders having a high green density does not prejudice the pumpability of the panel resulting from the porosity of the barriers.

The term "green density" is understood to mean the density measured on a powder specimen moulded in the form of a disc under a uniaxial pressure of $10^3$ kg/cm$^2$.

Preferably, 80% of the individual particles of the mineral filler have a size of between 0.3 μm and 10 μm; after baking, the particle size is unchanged overall.

Preferably, the particle size distribution of this filler is bimodal –5 to 20% of the particles have a size ranging between 0.3 and 1 μm and the rest of the particles have a mean size ranging between 3 and 5 μm.

Mineral fillers of unimodal distribution, the particle sizes of which are mostly between 1 and 2 μm, have also given excellent results.

The particle size corresponds here to the size of the individual particles, as may be observed in scanning electron microscopy.

Preferably, the mineral binder is a glass whose softening temperature is substantially below that of the substrate.

Preferably, the weight content of this glass in the powder of the barrier Material is greater than or equal to 2% and less than or equal to 10%—this content will be higher in the case of narrower barriers. In the case of barriers whose width is between 70 and 100 μm, the best results have been obtained for contents of between 2 and 5%. Tests carried out with a weight content of about 2% have given the best results, provided that the maximum temperature reached during the baking step exceeds the softening temperature of the glass used by at least 40° C. The mechanical strength of the baked barriers obtained exceeds $3\times10^5$ N/m$^2$.

Preferably, the mean particle size of the mineral binder is less than or equal to that of the mineral filler; thus, the mean size of the particles observed in scanning electron microscopy is typically about 1 μm.

Since the proportions of the two main components of the barrier powder are very different, their method of mixing is important in order to optimize the dispersion of the mineral binder around the mineral filler particles and to allow it to achieve significant consolidation of the barriers during the baking step. A typical operating method of mixing approximately 1 liter of powder consists in placing this powder in a container having a volume of approximately 4 liters and in stirring it dry using a blade 150 mm in diameter rotating at 7000 revolutions per minute for 4 to 12 minutes.

When a mineral filler is used which has a green density of about 65% of the theoretical density, or even higher, the best results, in terms of rate of ablation by sandblasting and ease of removing the mask and of screen printing the phosphors, have been achieved by starting with a green barrier layer containing approximately 4% by weight of organic binder. The mechanical strength of the baked barriers obtained then exceeds $3\times10^5$ N/m$^2$.

The subject of the invention is also a tile for a plasma panel provided with an array of barriers defining plasma discharge cells, comprising a mineral filler and a mineral binder, capable of being obtained by the process according to the invention, characterized in that:

- the weight content of mineral binder in these barriers is less than 13% and greater than, 0.1%;
- the bulk density of the said barriers is less than 75% of the theoretical density of the mineral filler of the said barriers.

The invention may also have one or more of the following features:

- the tile includes at least one array of electrodes placed beneath the said array of barriers so as to supply the cells between the barriers;
- the tile also includes a dielectric layer placed between the electrodes and the array of barriers;
- these barriers are formed from particles whose size is less than or equal to 10 μm;
- these barriers have a width of less than or equal to 100 μm;
- the weight content of mineral binder in these barriers is between 2 and 5%.

The subject of the invention is also a plasma panel comprising at least one tile provided with an array of barriers according to the invention.

To manufacture such a plasma panel from a tile provided with an array of barriers according to the invention, in a manner known per se, this tile is joined to another suitable tile, the air trapped between these tiles is evacuated and the panel is filled with low-pressure discharge gas.

Thanks to the open porosity of the barriers of the array according to the invention, the air is evacuated easily and quickly by pumping.

Thanks to the adsorptivity of the pores of these barriers, the risk of the panel malfunctioning owing to discharge faults is reduced and the lifetime of the panel is increased.

The invention will be more clearly understood on reading the description of a more detailed method of implementation, given by way of non-limiting example.

The starting point is a tile of soda-lime glass of dimensions 254 mm×162 mm×3 mm, provided with an array of electrodes formed by silver conductors, the array itself being coated with a conventional dielectric layer baked at 580° C.

The method of implementing the invention in order to obtain, on this tile, or more specifically on the dielectric layer, a 172 mm×100 mm array of parallel barriers arranged uniformly with a pitch of 306 μm will now be described.

A slip intended to form, after drying, a green barrier layer, comprising 4% by weight of organic binder and 2% by weight of mineral binder with the balance being a mineral filler, is prepared as follows:

preparation of a solution of organic binder: 8 g ethyl cellulose dissolved in 92 g of terpineol;

dry-preblending, in a high-speed blender, of:

200 g of mineral filler, in this case alumina in the form of a bimodal powder with individual particle sizes of 0.3 μm and 3 μm; BET specific surface area of 1 $m^2/g$; green density of 2.60 $g/cm^3$;

4 g of mineral binder, in this case lead silicate with 15 wt % of silica ($SiO_2$) in the form of a powder whose individual particles have a size essentially between 0.5 and 2 μm; softening temperature: approximately 400° C.;

dispersion of the dry powder blend (204 g) in 105 g of organic binder solution;

passage of the dispersion through a three-roll mill until the size of the aggregates of the powder in suspension is observed to be less than 7 μm; to check this size, a milling gauge is conventionally used, which comprises a groove of constant width (2 cm) but of variable depth (25 μm at one end and 0 μm at the other end); to determine the size of the aggregates, the dispersion is applied in the groove using a scraper blade and the level of the groove at which asperities start to appear on the scraped surface is determined; the depth of groove corresponding to this level gives the maximum size of the aggregates of the dispersion.

A barrier slip having a viscosity of about 33 Pa.s is thus obtained; next, several superposed layers of this slip are applied to the tile by screen printing as follows:

five screen-printing passes of the barrier slip using a polyester fabric consisting of 48 yarns per cm, each pass being followed by drying at 105° C.

A tile provided with a green barrier layer 105 μm in thickness is then obtained; next, a protective mask is applied to this layer in the following manner:

using a roll, hot pressure lamination (at 110° C.) of a dry photosensitive film 40 μm in thickness onto the green barrier layer;

after a mask, having openings 70 μm in width arranged in a regular manner with a pitch of 360 μm, has been applied against the film, irradiation of the photosensitive film through the mask with 200 $mJ/cm^2$ UV radiation;

development of the film by spraying, onto this film, an aqueous solution containing 0.2% sodium carbonate ($Na_2CO_3$) at 30° C., at a pressure of approximately $1.5\times10^5$ Pa, using nozzles whose orifices are spaced approximately 10 cm from the film.

After rinsing and drying, a tile is obtained which is provided with a green barrier layer and with a protective mask made of a polymer material having patterns corresponding to the array of barriers to be formed. At this stage, a slight compaction of the green layer, manifested by a reduction in thickness of about 5 μm, is observed.

To form the barriers, sandblasting is carried out using a nozzle with a 200 mm linear slot; a metal powder sold by Fuji, with the reference S9 grade 1000, is used as abrasive material. During the sandblasting operation, the sandblasting nozzle is kept at approximately 10 cm from the tile and moves at a speed of approximately 50 mm/min along the barriers to be formed, the green tile during sandblasting moves at a speed of 100 mm/min in a direction perpendicular to that of the barriers and the sandblasting pressure is about 0.05 MPa. It is possible for the tile to move at a higher speed, for example 170 mm/min, instead of 100 mm/min—the sandblasting pressure is then increased from 0.05 MPa to 0.08 MPa.

To remove the mask after the operation of forming the barriers, an aqueous solution containing 1% sodium hydroxide (NaOH) is sprayed at 35° C., at a pressure of approximately $0.4\times10^5$ Pa, against the green barrier layer formed, using nozzles whose orifices are placed at approximately 10 cm from the tile.

After rinsing with water and drying using an air knife at 50° C., a tile is obtained which is provided with an array of green barriers whose dimensions are the following: height about 100 μm; width at the base about 100 μm; width at the top about 70 μm. It has been found that, thanks to the process according to the invention, neither the development of the masking film nor, above all, its removal after sandblasting has damaged the barriers.

To apply a green layer of phosphors, phosphor slips are prepared by dispersing 60 g of powdered phosphors in 100 g of an aqueous polyvinyl alcohol (PVA) solution having a viscosity of about 0.3 Pa.s and then 7 g of ammonium dichromate ($NH_4Cr_2O_7$) and 11 g of conventional additives are added to this suspension, the ammonium dichromate making it photosensitive. A separate slip is prepared for each primary colour—red, green and blue.

To deposit a green layer of phosphors, especially on the sidewalls of the green barriers, the following are carried out:

whole-surface screen printing with one of the phosphor slips through a fabric consisting of 71 yarns/cm so as to obtain a layer approximately 15 μm in thickness after drying at 55° C.;

irradiation of the layer with 800 $mJ/cm^2$ UV, in a pattern corresponding to the regions to be coated with phosphors;

development of the layer by spraying water at 30° C. under pressure ($2\times10^5$ Pa);

drying at 65° C.

These operations are repeated for each primary colour. Thanks to the process according to the invention, it is found that neither the application of the screen-printing screens nor the development of the layers caused any damage to the barriers during these operations.

A tile provided with an array of green barriers, the sidewalls of which, between the other surfaces, are coated with a green layer of phosphors, is obtained.

The assembly is then baked. During baking, the maximum temperature is 450° C., this temperature being maintained for approximately 2 h 30' (150 minutes).

A tile provided with an array of phosphor-coated green barriers is obtained. Although the barriers obtained are porous, they have a high mechanical strength—no damage is observed when an average pressure of $3\times10^5$ Pa is exerted on this array, this being equivalent to a force of $15\times10^5$ $N/m^2$ on the top of the barriers.

The dimensions of the baked barriers are unchanged over those of the green barriers. This means that the porosity is very high, the open porosity of these barriers being about 30%. Since the porosity obtained is high and the observed post-bake shrinkage is insignificant, it is found that baking does not substantially modify the particle size of the mineral filler.

To obtain a plasma display panel, a conventional front tile is joined to the tile according to the invention, the latter being provided beforehand with a conventional seal. The two tiles are sealed by heat treatment at 400° C., the air contained between the tiles is evacuated by pumping, the panel is filled with a low-pressure discharge gas and the pumping opening is sealed.

Thanks to the very high open porosity of the barriers, it is found that the pumping operation is quick and easy—there is no sign of the barriers being crushed.

Finally, the tests carried out on the panel when in operation have shown that there are no discharge faults due to outgassing within the panel. This advantage is obtained owing to the adsorbent effect of the open pores of the barriers.

A variant of the above illustrative embodiment is used to obtain a tile provided not only with an array of barriers but also with a black matrix placed at the top of the barriers.

According to this variant, when depositing the green barrier layer the following additional steps are carried out:

- a black-matrix slip is prepared, this being intended to form, after drying, a black-matrix green layer comprising 7% by weight of organic binder, with no mineral binder, the balance being a mineral filler; more specifically, this slip is prepared in the following manner:
  - formation of a solution of 11 g ethyl cellulose in 89 g of terpineol;
  - dispersion, in 68 g of this solution, of 100 g of black oxide powder having the composition (Co,Fe)(Fe, Cr)$O_4$+Mn,Si, of unimodal particle size distribution with individual particles having a size between 0.5 and 1 μm,
  - passage of the dispersion through the three-roll mill until an aggregate size of less than 5 μm is obtained, the slip obtained having a viscosity of about 32 Pa.s;
- after the five screen-printing operations on the green barrier layers described above, a screen-printing pass is carried out with this black slip, using a polyester fabric containing 90 yams/cm; a black-matrix green layer having a thickness of approximately 10 μm is thus obtained.

The other steps of the process are unchanged.

This variant has two advantages: not only is a tile obtained which is provided both with an array of barriers and a black matrix intended to improve the contrast of the panel, but the top of these barriers is slightly compressible because the black-matrix slip does not contain any mineral binder. This weaker and compressible character of the top of the barriers makes it possible, when assembling the panel, to compensate for the variations in height of the barriers, or in flatness of the tiles, so as to ensure uniform contact of the top of the barriers with the other tile over their entire length, thereby preventing, inter alia, the phenomena of optical crosstalk between cells of the panel.

The invention claimed is:

1. Process for manufacturing an array of barriers made of a mineral material on a tile intended for the manufacture of a plasma display panel, comprising the following steps:

- on the tile, depositing a green barrier layer of uniform thickness comprising a powder of a barrier material and an organic binder;
- applying, to the green barrier layer, of a protective mask made of a polymer material, provided with patterns corresponding to the array of barriers to be formed;
- blasting of an abrasive material onto the mask so as to remove the green barrier layer between the patterns of the mask and to form green barriers comprising a base, a top and sidewalls;
- removing the mask;
- depositing a green layer, comprising a phosphor and an organic binder, at least on the sidewalls of the barriers;
- performing at least one baking operation, at least under conditions suitable for removing the organic binder from the green barrier layer and/or from the green layer of phosphors and, when baking the barrier layer, at least for consolidating the mineral barrier material; wherein:
- the powder of the barrier material comprises a mineral filler and a mineral binder, the weight content of mineral binder in this powder being less than 13% and greater than 0.1%; and
- the entire weight content of organic binder in the green barrier layer is less than 8% and greater than 0.1%.

2. Process according to claim 1, characterized in that it comprises no baking step between deposition of the green barrier layer and deposition of the green layer of phosphors, and in that these two green layers are baked simultaneously.

3. Process according to claim 2, wherein the entire weight content of organic binder in the green barrier layer is greater than or equal to 2%.

4. Process according to claim 2, wherein the particle size of the powder of the barrier material, especially of the mineral filler, the nature of the mineral binder, its weight content in this powder, the method of mixing the components in this powder and the baking conditions are tailored so that the bulk density of the barriers obtained after baking is less than 75% of the theoretical density of the material of the mineral filler.

5. Process according to claim 4, wherein the conditions for the simultaneous baking are suitable for preventing any significant shrinkage during this baking.

6. Process according to claim 4, wherein the maximum temperature reached during the simultaneous baking is more than 20° C. to 50° C. above the softening temperature of the mineral binder.

7. Process according to claims 4, wherein the particle size of the powder of the barrier material, especially of the mineral filler, the nature of the mineral binder, its weight content in this powder, the method of mixing the components of this powder and the baking conditions are tailored so that the barriers obtained after baking have a mechanical strength allowing it to withstand a pressure of greater than $3\times10^5$ N/$m^2$.

8. Process according to claims 4, wherein in the mineral filler is chosen from the group comprising alumina, zirconia, yttrium oxide titanium oxide and mixtures thereof.

9. Process according to claims 4, wherein the mineral filler has a green density of at least 65% of its theoretical density, the green density being measured on a powder specimen moulded in the form of a disc under a uniaxial pressure of $10^3$ kg/$cm^2$.

10. Process according to claims 4, wherein 80% of the individual particles of the mineral filler have a size of between 0.3 μm and 10 μm.

11. Process according to claims 4, wherein the weight content of mineral binder in the powder of the barrier material is greater than or equal to 2% and less than or equal to 10%.

12. Tile for a plasma panel provided with an array of barriers defining plasma discharge cells, comprising a mineral filler and a mineral binder, capable of being obtained by the process according to claims 4, wherein:

- the weight content of mineral binder in these barriers is less than 13% and greater than 0.1%;
- the bulk density of the barriers is less than 75% of the theoretical density of the mineral filler of the barriers.

13. Tile according to claim 12, wherein it includes at least one array of electrodes placed beneath the array of barriers so as to supply the cells between the barriers.

14. Tile according to claim 13, wherein it includes a dielectric layer placed between the electrodes and the array of barriers.

15. Tile according to claims 12, wherein the barriers are formed from particles whose size is less than or equal to 10 μm.

16. Tile according to claim 15, wherein the barriers have a width of less than or equal to 100 μm.

17. Tile according to claim 16, wherein the weight content of mineral binder in the barriers is between 2 and 5%.

18. Plasma panel comprising at least one tile according to claims 12.

* * * * *